US009793639B1

(12) United States Patent
Morello et al.

(10) Patent No.: US 9,793,639 B1
(45) Date of Patent: Oct. 17, 2017

(54) ELECTRICAL CONNECTOR SYSTEM WITH MULTIPLE FLEXIBLE TERMINAL RETAINING BEAMS

(71) Applicant: Delphi Technologies, Inc., Troy, MI (US)

(72) Inventors: John R. Morello, Warren, OH (US); James M. Rainey, Warren, OH (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/422,552

(22) Filed: Feb. 2, 2017

(51) Int. Cl.

| | |
|---|---|
| ***H01R 13/40*** | (2006.01) |
| ***H01R 13/422*** | (2006.01) |
| ***H01R 43/22*** | (2006.01) |
| ***H01R 43/18*** | (2006.01) |
| ***H01R 13/10*** | (2006.01) |

(52) U.S. Cl.
CPC ..... *H01R 13/4226* (2013.01); *H01R 13/10* (2013.01); *H01R 43/18* (2013.01); *H01R 43/22* (2013.01)

(58) Field of Classification Search
CPC .. H01R 13/40; H01R 13/422; H01R 13/4223; H01R 13/4226; H01R 13/434
USPC ..... 439/595, 603, 744, 752, 869, 871
See application file for complete search history.

(56) References Cited

U.S. PATENT DOCUMENTS 5,980,318 A 11/1999 Morello et al.
6,280,250 B1 * 8/2001 Ko ..... H01R 4/185 439/595
6,767,259 B2 * 7/2004 Kojima ..... H01R 13/114 439/595
7,048,584 B1 * 5/2006 Morello ..... H01R 13/422 439/595
7,396,255 B2 * 7/2008 Morello ..... H01R 13/4223 439/595
7,635,286 B1 * 12/2009 Morello ..... H01R 13/055 439/752.5
7,658,645 B1 * 2/2010 Morello ..... H01R 13/4223 439/595
8,376,778 B2 * 2/2013 Obata ..... H01R 13/4223 439/595
9,071,016 B2 * 6/2015 Morello ..... H01R 13/6272
9,300,075 B2 * 3/2016 Matsumura ..... H01R 13/4223
2006/0292928 A1 12/2006 Morello et al.

* cited by examiner

*Primary Examiner* — Chandrika Prasad
(74) *Attorney, Agent, or Firm* — Robert J. Myers

(57) ABSTRACT

An electrical connector system including a connector having a terminal cavity within. The cavity has a rigid floor with a lock nib extending into the cavity, a first flexible beam extending into a rearward portion of the cavity and a second flexible beam extending into a forward portion. The first and second beams both overlie the floor. The system further includes a terminal having a top surface and a bottom surface defining a rigid lock edge. The terminal is received in the cavity such that the first beam engages a rearward portion of the top surface of the terminal and the second beam engages a forward portion of the top surface, thereby biasing the terminal towards the floor. The lock edge engages the lock nib, thereby preventing the terminal from being inadvertently withdrawn from the terminal receiving cavity. The connector may be formed by an additive manufacturing process.

15 Claims, 2 Drawing Sheets

ELECTRICAL CONNECTOR SYSTEM WITH MULTIPLE FLEXIBLE TERMINAL RETAINING BEAMS

TECHNICAL FIELD OF THE INVENTION

The invention generally relates to electrical connector systems, and more particularly relates to an electrical connector system having a terminal retained within a terminal receiving cavity of a connector body.

BACKGROUND OF THE INVENTION

It is common in the prior art to provide an electrical connector having a terminal received in a terminal cavity of a connector body. The terminal may be held in the connector body by flexible locking tangs or fingers. The flexible locking tangs or fingers may be formed as a part of the terminal or the connector body. Terminals having flexible locking tangs or fingers are complicated structures to manufacture, often having at least two separate pieces to be assembled and often are large and bulky. Similarly, connector bodies having flexible locking tangs or fingers are large and bulky, and are difficult to tool and injection mold. Another disadvantage of these devices having flexible locking tangs or fingers is that the system provides only a flexible locking member engaging a rigid locking member. Unfortunately, the flexible locking member may become inadvertently disengaged, allowing the terminal to be removed from the connector body.

U.S. Pat. No. 5,980,318 discloses an electrical connector having a terminal receiving cavity defined in part by a rigid floor wall that has a rigid lock nib that extends upwardly from the rigid floor wall into the terminal receiving cavity. A flexible beam opposes the rigid floor wall, and a ceiling wall includes a terminal hold down bump extending toward the rigid floor wall at a location generally opposite the rigid lock nib. The connector body receives a terminal in each terminal receiving cavity. Each terminal has a recess defined in part by a rigid lock bar. That is attached to side walls of the terminal. The rigid lock nib is disposed in the terminal recess when the terminal is fully seated in the terminal cavity with the rigid lock bar engaging the rigid lock nib to prevent the seated terminal from being pulled out of the terminal cavity.

The invention described herein provides alternatives to and advantages over the prior art.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to an embodiment, an electrical connector system is presented. The electrical connector system includes a connector body having a terminal receiving cavity formed therein. The terminal receiving cavity is defined in part by a rigid floor having a rigid lock nib extending from the rigid floor into the terminal receiving cavity, a first flexible beam extending into a rearward portion of the terminal receiving cavity overlying the rigid floor, and a second flexible beam distinct from the first flexible beam also extending into a forward portion of the terminal receiving cavity and overlying the rigid floor. The electrical connector system further includes a terminal having a first end configured to connect with a corresponding mating terminal and a second end configured to be secured to a wire. The first end has a top surface and a bottom surface defining a rigid lock edge. The terminal is received in the terminal receiving cavity such that the first flexible beam engages a rearward portion of the top surface of the terminal and the second flexible beam engages a forward portion of the top surface of the terminal, thereby biasing the terminal towards the rigid floor. The rigid lock edge engages the rigid lock nib, thereby preventing the terminal from being inadvertently withdrawn from the terminal receiving cavity.

The first flexible beam may further include a terminal hold down bump extending into the terminal receiving cavity at a location rearward of the rigid lock nib. The first flexible beam may be characterized as a fixed beam secured at first and second ends and detached along opposed sides.

The second flexible beam may be characterized as a cantilever beam having a first portion with a fixed end affixed to the connector body extending rearwardly in the terminal receiving cavity to a second portion extending forwardly in the terminal receiving cavity to a free end extending into the terminal receiving cavity at a location forward of the rigid lock nib.

The connector body may have a first face defining a first opening to the terminal receiving cavity for receiving the corresponding mating terminal therethrough and a second face defining a second opening to the terminal receiving cavity for receiving the terminal therethrough. The first face may include a third opening for a channel communicating with the terminal receiving cavity. The channel is configured for insertion of an elongate tool to contact the bottom surface of the terminal in the terminal receiving cavity. The channel is non-parallel to the rigid floor. The channel defines an acute angle relative to the rigid floor in a range of 10 to 60 degrees. The channel enters the terminal receiving cavity forward of the rigid lock nib. The tool may be configured to confirm that the terminal is present within the terminal receiving cavity and that the bottom surface is in contact with the rigid floor. The tool may be a second tool configured to push the terminal away from the rigid floor such that the rigid lock edge disengages the rigid lock nib.

The connector body may define a plurality of terminal receiving cavities. The first face defines a plurality of first openings and third openings to the plurality of terminal receiving cavities and does not define any other openings to the plurality of terminal receiving cavities.

The connector body and first and second flexible beams may be formed by an additive manufacturing process selected from a list consisting of stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP). The first and second flexible beams may be formed of a glass filled polymer material.

The terminal may be a female terminal and the first end is open to receive a corresponding male terminal.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

The electrical connector system described herein includes a pair terminal hold down beams that are configured to apply a spring force to a terminal disposed within a terminal cavity of a connector body to maintain engagement of the terminal with a terminal lock nib that inhibits removal of the terminal from the terminal cavity.

In the following description, terms describing orientation such as "longitudinal" will refer to the mating axis X while "lateral" should be understood to refer to an axis perpendicular to the mating axis X, which is not necessarily the transverse axis. Furthermore, other terms such as "top" or "bottom" should be understood relative to an axis perpendicular to the mating axis X, which is not necessarily the vertical axis. As used herein the terms "front" and "forward" refer to a lateral orientation referenced from the connector body towards the corresponding mating connector body and the terms "back", "rear", "rearward", and "behind" refer to a lateral orientation referenced from the corresponding mating connector body towards the connector body.

Figure 1:
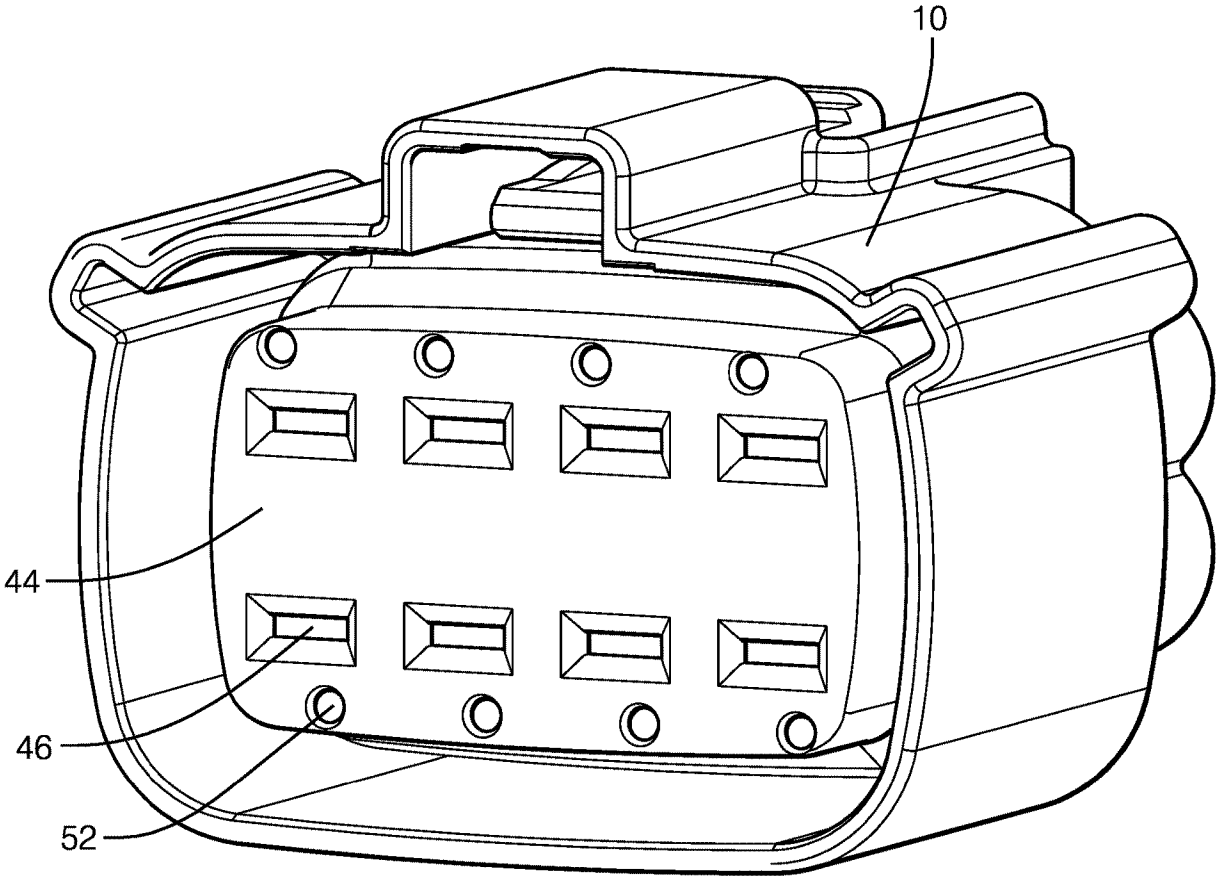
FIG. 1 is a perspective view of an electrical connector system in accordance with one embodiment.
Figure 2:
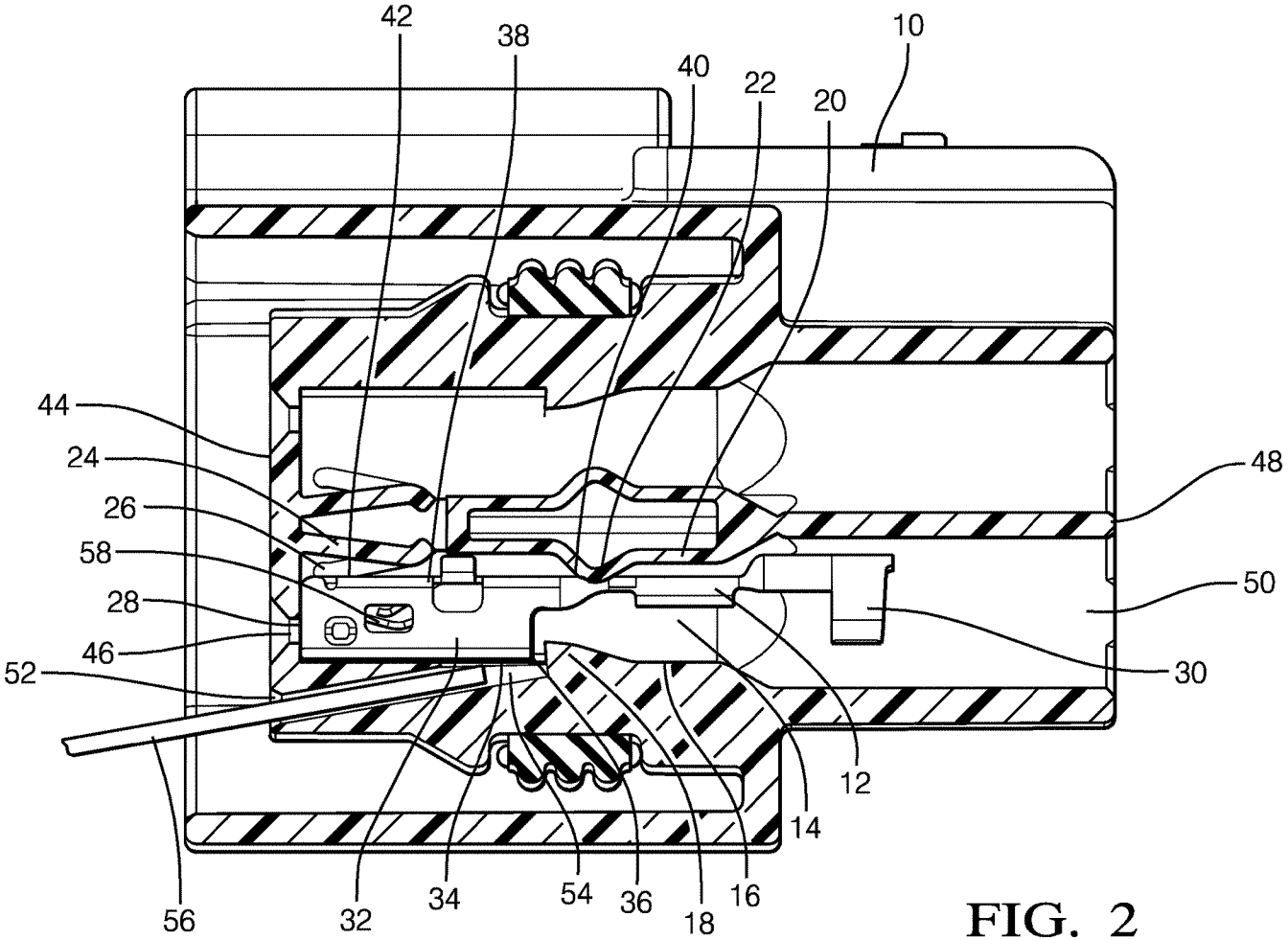
FIG. 2 is a cut-away side view of a connector body of the electrical connector system of FIG. 1 in accordance with one embodiment.

FIGS. 1 and 2 illustrate a non-limiting example of an electrical connector system having a connector body 10 that holds a plurality of female electrical terminals 12 configured to terminate wire cables (not shown) that is configured to connect with a corresponding mating second connector body (not shown) that holds a plurality of male electrical terminals (not shown) configured to interconnect with the female electrical terminals 12 within the connector body 10.

As shown in FIG. 2, the connector body 10 that has a terminal receiving cavity 14, hereinafter referred to as the terminal cavity 14, formed therein. The terminal cavity 14 is defined in part by a rigid floor 16 that has a rigid lock nib 18 extending from the floor 16 into the terminal cavity 14.

The terminal cavity 14 also includes a first flexible terminal hold down beam 20, hereinafter referred to as the first beam 20, extending into a rearward portion of the terminal cavity 14 and overlies the floor 16 of the terminal cavity. The first beam 20 further includes a terminal hold down bump 22 extending into the terminal receiving cavity at a location rearward of the lock nib 18. The first beam 20 is characterized as a fixed beam meaning that the first beam 20 secured to the connector body 10 at first and second ends and is detached from the connector body 10 along opposed sides.

The terminal cavity 14 further includes a second terminal hold down beam, hereinafter referred to as the second beam 24, that is distinct from the first beam 20. A first portion of the second beam 24 is attached to the connector body 10 at one end and extends rearwardly in the terminal cavity 14 toward the floor 16. A second portion of the second beam 24 is attached to the other end of the first portion and extends forwardly in the terminal cavity 14 and further toward the floor 16 to a free end 26. The free end 26 of the second beam 24 extends into a forward portion of the terminal cavity 14 and overlies the floor 16 at a location forward of the lock nib 18.

The illustrated female terminal 12 has an open end 28 that is configured to receive the corresponding male terminal, an attachment end 30, and a body portion 32 intermediate the open and attachment ends 28, 30. The body portion 32 has a bottom surface 34 that includes a rearward edge that is configured to contact the lock nib 18. The rearward edge defines a rigid lock edge 36 of the bottom surface 34 with which the lock nib 18 engages. The body portion 32 also has a top surface 38 that has a first portion 40 that is located rearward of the lock edge and a second portion 42 that is located forward of the lock edge 36. The attachment end 30 illustrated here comprises a pair of crimping wings that are configured to be mechanically crimped to the stands of the wire. Other means for attaching the wire to the terminal 12, such as soldering or sonic welding may be used and the design of the attachment end 30 may be revised accordingly. The terminal 12 may be formed of a sheet of a conductive material, such as a tin plated copper material, by a process of stamping and bending. While the embodiment illustrated in FIG. 2 is a female socket terminal 12 configured to receive a male blade terminal, other embodiments of the electrical connector system may be envisioned using other terminal types. Further, while the terminal 12 illustrated in FIG. 2 has a lock edge defined by the rear edge of the body of the terminal, alternative embodiments may be envisioned wherein the lock edge is defined by a recess in the bottom surface 34 of the terminal 12.

As the terminal 12 is received in the terminal cavity 14, the bottom surface 34 of the terminal 12 contacts the inclined rearward surface of the lock nib 18 and the top surface 38 contacts the inclined rearward surface of terminal hold down bump 22. As the terminal 12 is pushed into the terminal cavity 14, the terminal 12 is pushed upwardly in the terminal cavity 14 by the lock nib 18 and causing the first beam 20 to flex upwardly. After the lock edge 36 is pushed beyond the ridge formed by the junction of the rearward and forward surfaces of the lock nib 18, the first beam 20 springs back to a partially deflected position and the lock edge 36 engages the lock nib 18, thereby preventing the terminal 14 from being inadvertently withdrawn from the terminal cavity 14. When the lock nib 18 engages the lock edge 36, the terminal hold down bump 22 of the first beam 20 engages the first portion 40 of the top surface 38 and the free end 26 of the second beam 24 engages the second portion 42 of the top surface 38. Both the first and second beams 20, 24 remain partially flexed and exert a spring force on the terminal 12, thereby biasing the terminal 12 towards the floor 16. The spring force exerted on the terminal 12 by the first and second beams 20, 24 is sufficient to retain the terminal 12 within the terminal cavity 14 during the assembly of the connector body 10 to the mating connector body.

While the example of the connector body 10 illustrated in FIG. 2 has a first beam 20 that is a flexible fixed beam and a second beam 24 that is a flexible cantilevered beam, alternative embodiments of the invention may be envisioned wherein the first beam is a cantilevered flexible beam. Yet other alternative embodiments of the invention may be envisioned wherein the second beam is a fixed flexible beam.

The connector body 10 has a front face 44 that defines a first opening 46 to the terminal cavity 14 that is configured to for receiving the corresponding male terminal therethrough and has a rear face 48 defining a second opening 50 to the terminal cavity 14 configured for receiving the terminal therethrough. The front face 44 also defines a third opening 52 for a channel 54 leading from the front face 44 to the terminal cavity 14. The channel 54 is configured for insertion of an elongate tool 56 to contact the bottom surface 34 of the terminal 12 in the terminal cavity 14. The front face 44 does not define any other openings to terminal cavities 14 other than first and third openings 44, 52.

The channel 54 is non-parallel to the floor 16 of the terminal cavity 14. The channel 54 defines an acute angle relative to the floor 16 that is in a range of 10 to 60 degrees. The channel 54 enters the terminal cavity 14 forward of the lock nib 18. The tool 56 may be used for at least two different purposes. The tool 56 may be used to confirm that the terminal 12 is present within the terminal cavity 14 and that the bottom surface 34 is in contact with the floor 16. The tool 56 may be a gauge that indicates the proper depth of insertion into the channel 54 at which the presence of the terminal 12 is properly detected. The tool 56 may additionally or alternatively be a conductive tool configured to test electrical continuity between and energized terminal 12 and the tool 56. Additionally or alternatively the tool 56 may be used to push the terminal 12 away from the floor 16 such that the lock edge 36 disengages the lock nib 18, allowing the terminal 12 to be removed from the terminal cavity 14 through the second opening 50. Because the tool 56 is configured to contact the bottom surface 34 of the terminal 12, the tool 56 is unlikely to cause damage to the mating surfaces 58 in the open end 28 of the terminal 12 that are accessible through the first opening.

The connector body 10, including the first and second beams 20, 24, is preferably formed of a glass filled polymeric material. The shape of the first and second beams 20, 24 would be very difficult to form using conventional injection molding technology due the complexity of the mold that would be required to form the desired shapes, therefore, the connector body 10 is preferably formed by an additive manufacturing process such as stereolithography (SLA), digital light processing (DLP), fused deposition modeling (FDM), fused filament fabrication (FFF), selective laser sintering (SLS), selecting heat sintering (SHS), multi-jet modeling (MJM), or 3D printing (3DP). Additive manufacturing process While the connector body 10 illustrated herein defines a pair of terminals 12, cavities 14, and associated structures, other embodiments of the connector system may be envisioned having a single terminal or more than two terminals. The more than two terminals may be arranged in several different rows and columns.

Accordingly an electrical connector assembly 10 is provided. The electrical connector assembly 10 provides the benefit of a lower terminal insertion force since the biasing force on the terminal is applied by two separate flexible beams both forward and rearward of the lock edge. The angled channel 54 further provides the benefits of accessing the bottom surface 34 of the terminal 12 to verify placement of the terminal 12 in the terminal cavity 14 and removing the terminal 12 from the terminal cavity 14 without contacting the mating surfaces 58 of the terminal 12, eliminating the opportunity to damage the mating surfaces 58 of the terminal 12 by the tool 56. Forming the connector body 10 using an additive manufacturing processes also allows the first and second beams 20, 24 to be shaped in a configuration that may be difficult or impossible to obtain with conventional injection molding techniques.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector system, comprising:

a connector body having a terminal receiving cavity formed therein, the terminal receiving cavity being defined in part by a rigid floor having a rigid lock nib extending from the rigid floor into the terminal receiving cavity, a first flexible beam extending into a rearward portion of the terminal receiving cavity overlying the rigid floor, and a second flexible beam distinct from the first flexible beam also extending into a forward portion of the terminal receiving cavity and overlying the rigid floor; and a terminal having a first end configured to connect with a corresponding mating terminal and a second end configured to be secured to a wire, said first end having a top surface and a bottom surface defining a rigid lock edge, wherein the terminal is received in the terminal receiving cavity such that the first flexible beam engages a rearward portion of the top surface of the terminal and the second flexible beam engages a forward portion of the top surface of the terminal, thereby biasing the terminal towards the rigid floor and wherein the rigid lock edge engages the rigid lock nib, thereby preventing the terminal from being inadvertently withdrawn from the terminal receiving cavity.

2. The electrical connector system according to claim 1, wherein the first flexible beam further includes a terminal hold down bump extending into the terminal receiving cavity at a location rearward of the rigid lock nib.

3. The electrical connector system according to claim 2, wherein the first flexible beam is characterized as a fixed beam secured at first and second ends and detached along opposed sides.

4. The electrical connector system according to claim 1, wherein the second flexible beam is characterized as a cantilever beam having a first portion with a fixed end affixed to the connector body extending rearwardly in the terminal receiving cavity to a second portion extending forwardly in the terminal receiving cavity to a free end extending into the terminal receiving cavity at a location forward of the rigid lock nib.

5. The electrical connector system according to claim 1, wherein the connector body has a first face defining a first opening to the terminal receiving cavity for receiving the corresponding mating terminal therethrough and a second face defining a second opening to the terminal receiving cavity for receiving the terminal therethrough.

6. The electrical connector system according to claim 5, wherein the first face includes a third opening for a channel communicating with the terminal receiving cavity, said channel configured for insertion of an elongate tool to contact the bottom surface of the terminal in the terminal receiving cavity.

7. The electrical connector system according to claim 6, wherein the channel is non-parallel to the rigid floor.

8. The electrical connector system according to claim 7, wherein the channel defines an acute angle relative to the rigid floor in a range of 10 to 60 degrees.

9. The electrical connector system according to claim 6, wherein the channel enters the terminal receiving cavity forward of the rigid lock nib.

10. The electrical connector system according to claim 9, wherein the connector body defines a plurality of terminal receiving cavities and wherein the first face defines a plurality of first openings and third openings to the plurality of terminal receiving cavities and does not define any other openings to the plurality of terminal receiving cavities.

11. The electrical connector system according to claim 6, wherein the tool is a first tool configured to confirm that the terminal is present within the terminal receiving cavity and that the bottom surface is in contact with the rigid floor.

12. The electrical connector system according to claim 6, wherein the tool is a second tool configured to push the terminal away from the rigid floor such that the rigid lock edge disengages the rigid lock nib.

13. The electrical connector system according to claim 1, wherein the connector body and the first and second flexible beams are formed by an additive manufacturing process selected from a list consisting of stereolithography (SLA), digital light processing (DLP), fused deposition modeling (FDM), fused filament fabrication (FFF), selective laser sintering (SLS), selecting heat sintering (SHS), multi-jet modeling (MJM), and 3D printing (3DP).

14. The electrical connector system according to claim 13, wherein the first and second flexible beams are formed of a glass filled polymer material.

15. The electrical connector system according to claim 1, wherein the terminal is a female terminal and the first end is open to receive a corresponding male terminal.

* * * * *